US010944211B1

(12) United States Patent
Ho et al.

(10) Patent No.: US 10,944,211 B1
(45) Date of Patent: Mar. 9, 2021

(54) CONNECTOR WITH QUICK POSITIONING STRUCTURE

(71) Applicants: KUNSHAN AMPHENOL ZHENGRI ELECTRONICS CO., LTD., Kunshan (CN); Amphenol LTW Technology Co., Ltd., New Taipei (TW)

(72) Inventors: Chia-Nan Ho, New Taipei (TW); Chu-Hsueh Lee, New Taipei (TW)

(73) Assignees: KUNSHAN AMPHENOL ZHENGRI ELECTRONICS CO., LTD., Jiangsu Province (CN); AMPHENOL LTW TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/783,393

(22) Filed: Feb. 6, 2020

(30) Foreign Application Priority Data

Nov. 15, 2019 (TW) ..... 108141652

(51) Int. Cl.
*H01R 13/629* (2006.01)
*H01R 13/622* (2006.01)
*H01R 13/424* (2006.01)

(52) U.S. Cl.
CPC ..... *H01R 13/62955* (2013.01); *H01R 13/424* (2013.01); *H01R 13/622* (2013.01)

(58) Field of Classification Search
CPC ..... H01R 13/62955; H01R 13/424; H01R 13/622
(Continued)

(56) References Cited

U.S. PATENT DOCUMENTS 3,937,547 A * 2/1976 Lee-Kemp ..... F16L 37/098 439/352
4,545,633 A * 10/1985 McGeary ..... H01R 13/6277 439/141
(Continued)

FOREIGN PATENT DOCUMENTS

CN 201117937 Y 9/2008
CN 201323310 Y * 10/2009
(Continued)

OTHER PUBLICATIONS

Search Report dated Jul. 23, 2020 of the corresponding European patent application No. 20158606.2.
(Continued)

*Primary Examiner* — Peter G Leigh
(74) *Attorney, Agent, or Firm* — Chun-Ming Shih; HDLES IPR Services

(57) ABSTRACT

A connector includes a terminal group installed in a base, an inner socket fixed onto the base for passing the terminal group, and a positioning ring including a ring plate sheathed on the inner socket, and elastic plates and hooks connected to the ring plate. The elastic plates are spaced from each other and arranged circularly on the ring plate; the hooks are formed on the elastic plate and configured to be different or partially the same up to an axial distance of the horizontal plane; the outer socket includes an outer circular seat outside the inner socket and connected to an outer circular plate of the outer circular seat; the outer circular plate has notches corresponding to the hooks; the outer circular seat is sheathed on the positioning ring to protrude the hook from the notches. The connector further includes a socket structure for engaging the plug structure.

14 Claims, 15 Drawing Sheets

(58) Field of Classification Search
USPC ..... 439/376
See application file for complete search history.

(56) References Cited

U.S. PATENT DOCUMENTS

| | | | | |
|---|---|---|---|---|
| 7,318,609 | B2 * | 1/2008 | Naito | F16L 37/133 285/307 |
| 7,727,021 | B2 * | 6/2010 | Haruna | H01R 9/037 439/607.5 |
| 7,758,370 | B1 * | 7/2010 | Flaherty | H01R 24/50 439/352 |
| 8,192,218 | B2 * | 6/2012 | Sasaki | H01R 13/623 439/320 |
| 8,939,783 | B2 * | 1/2015 | Pfeiffer | H01R 13/633 439/314 |
| 9,124,031 | B2 * | 9/2015 | Su | H01R 13/506 |
| 9,276,356 | B2 * | 3/2016 | Yu | H01R 13/629 |
| 9,318,844 | B2 * | 4/2016 | Yu | H01R 27/00 |
| 9,570,853 | B1 * | 2/2017 | Yu | H01R 13/6277 |
| 10,211,568 | B2 * | 2/2019 | Blakborn | H01R 13/508 |
| 2006/0051999 | A1 * | 3/2006 | Allemann | H01R 13/622 439/320 |
| 2013/0122735 | A1 * | 5/2013 | Pfeiffer | H01R 13/633 439/372 |
| 2014/0235085 | A1 * | 8/2014 | Su | H01R 13/6277 439/346 |

FOREIGN PATENT DOCUMENTS

| | | | | | |
|---|---|---|---|---|---|
| CN | 101656380 | A | | 2/2010 | |
| CN | 103633489 | A | * | 3/2014 | |
| CN | 103633489 | A | | 3/2014 | |
| CN | 106941221 | A | | 7/2017 | |
| EP | 3273548 | A1 | | 1/2018 | |
| EP | 3358682 | A1 | * | 8/2018 | H01R 13/6275 |
| EP | 3358682 | A1 | | 8/2018 | |
| TW | M381200 | U | | 5/2010 | |
| TW | M590810 | U | | 2/2020 | |
| WO | 2015184082 | A1 | | 12/2015 | |
| WO | 2017030573 | A1 | | 2/2017 | |

OTHER PUBLICATIONS

Office action dated Sep. 29, 2020 of the corresponding Taiwan patent application No. 108141652.

* cited by examiner

CONNECTOR WITH QUICK POSITIONING STRUCTURE

BACKGROUND OF THE INVENTION

1. Technical Field

The technical field relates to a connector, and more particularly to a connector with a quick positioning structure.

2. Description of Related Art

Traditionally, most cable connectors are connected by a method such as quick plug and unplug, rotary locking, or screw tightening method, but the rotary locking or screw tightening method requires more space for use and thus these methods cannot be applied in places with limited space. Although the quick plug and unplug method is convenient, the cable connector may be loosened or detached easily when it is pulled or shaken by external forces, so that this method is unable to ensure the expected connection effect.

In addition, the conventional cable connectors have various types of plugs and sockets, but most of different types of plugs work with one respective type of sockets only, so that the conventional cable connectors fail to meet the requirements for the high efficiency and multi-function in modern industries.

In view of the aforementioned drawbacks of the prior art, the discloser of this disclosure based on years of experience in the related industry to conduct extensive research and experiment, and finally provided a feasible solution as disclosed in this disclosure to overcome the drawbacks of the prior art.

SUMMARY OF THE INVENTION

Therefore, it is a primary object of this disclosure to overcome the aforementioned drawback of the prior art by providing a connector with a quick positioning structure, and its plug structure includes a plurality of hooks of different heights formed on a positioning ring, and at least three hooks are engaged with a thread of a socket structure, so that the plug structure can be positioned into the socket structure quickly without the risk of separation.

Another objective of this disclosure is to provide a connector with a quick positioning structure, wherein the hooks of the plug structure can be engaged with different types of threads, so that the connector still fits the plug structure when the socket structure comes with a different specification, and this disclosure improves the flexibility and practicality of use.

To achieve the aforementioned and other objectives, this disclosure discloses a connector with a quick positioning structure, whose plug structure comprises a base, a terminal group, an inner socket, a positioning ring and an outer socket. The terminal group is installed in the base; the inner socket is fixed onto the base for passing the terminal group; the positioning ring is sheathed on the inner socket and comprises a ring plate, and a plurality of elastic plates and a plurality of hooks coupled to the ring plate, and the elastic plates are spaced from each other and arranged circularly on the ring plate, and the hooks are disposed on the elastic plate and configured to be different or partially the same up to an axial distance of the horizontal plane; the outer socket comprises an outer circular seat disposed outside the inner socket and an outer circular plate coupled to the outer circular seat, and the outer circular plate has a plurality of notches configured to be corresponsive to the hooks respectively, and the outer circular seat is sheathed on the ring body to protrude the hooks out of the notches.

To achieve the aforementioned and other objectives, this disclosure provides a connector with a quick positioning structure and a socket structure, and the socket structure comprises a socket body and a plurality of threads formed in the socket body, and an inner socket of a plug structure is inserted into the socket body to engage the plurality of hooks with the threads.

Compared with the prior art, the plug structure of the connector with a quick positioning structure of this disclosure comprises a positioning ring, and the positioning ring has plurality of elastic plates spaced from each other and arranged into a circular shape, and the elastic plates have a plurality of hooks with different heights; and after the plug structure and the socket structure are engaged with each other, at least three hooks will abut against the thread of the socket structure to achieve the effect of positioning the connector quickly and surely. Since the hooks of the plug structure can abut against different types of threads, therefore the flexibility and practicality of the connector of this disclosure can be improved.

DESCRIPTION OF THE PREFERRED EMBODIMENTS

The technical contents of this disclosure will become apparent with the detailed description of preferred embodiments accompanied with the illustration of related drawings as follows. It is intended that the embodiments and drawings disclosed herein are to be considered illustrative rather than restrictive.

Figure 1:
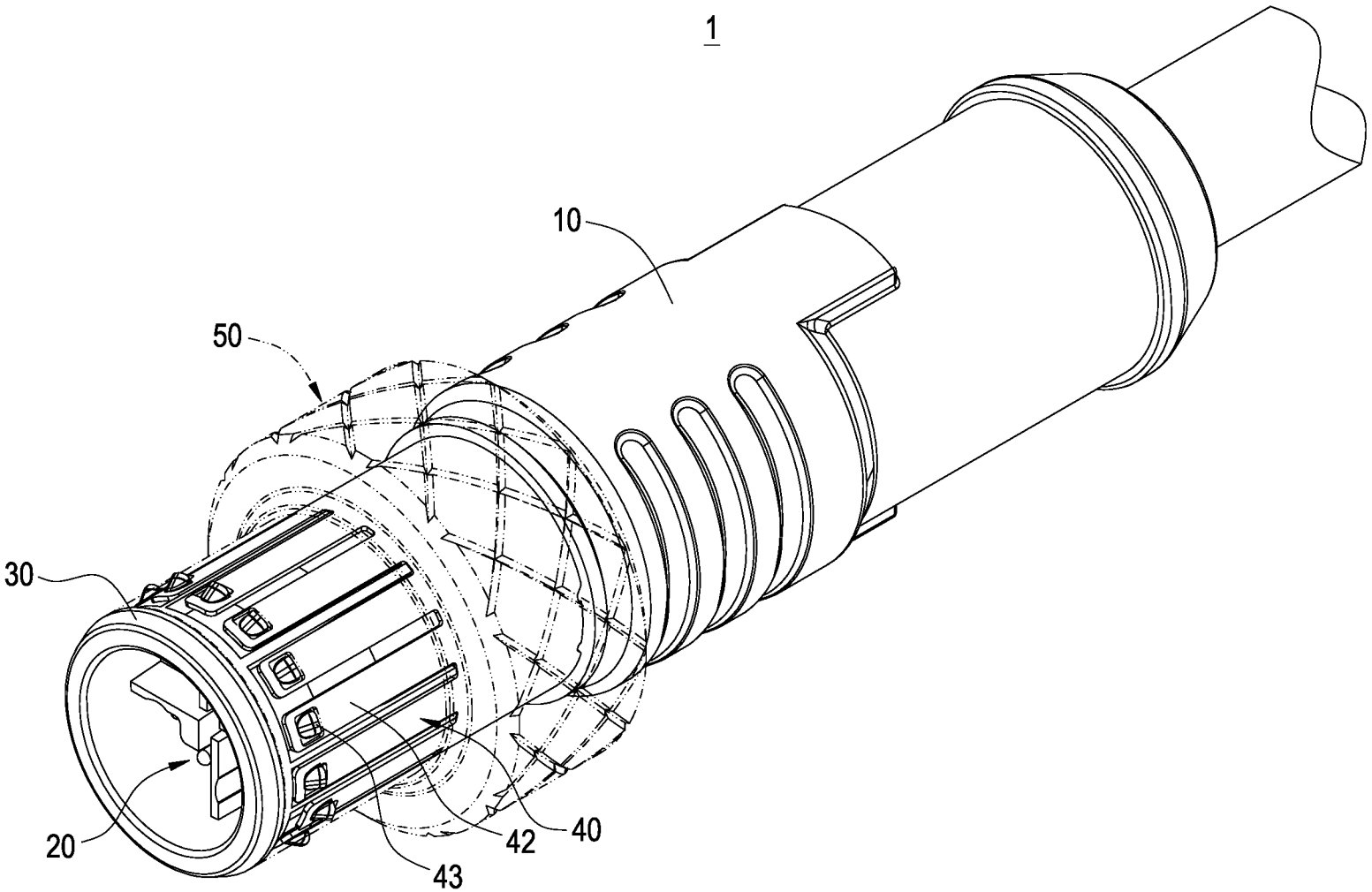
FIG. 1 is a perspective view of a connector with a quick positioning structure in accordance with this disclosure.
Figure 2:
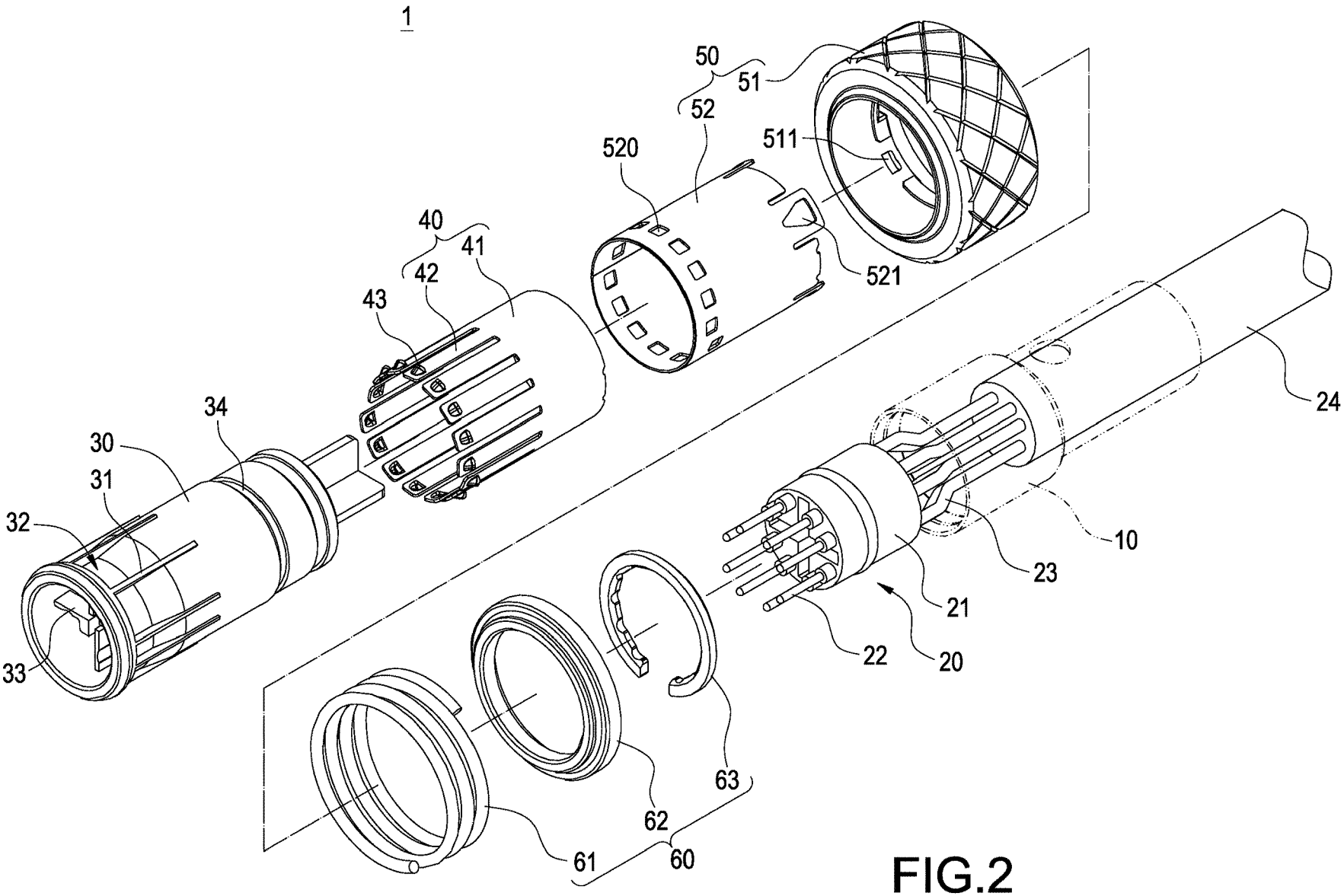
FIGS. 2 and 3 are two exploded views of a connector with a quick positioning structure in accordance with this disclosure respectively.
Figure 3:
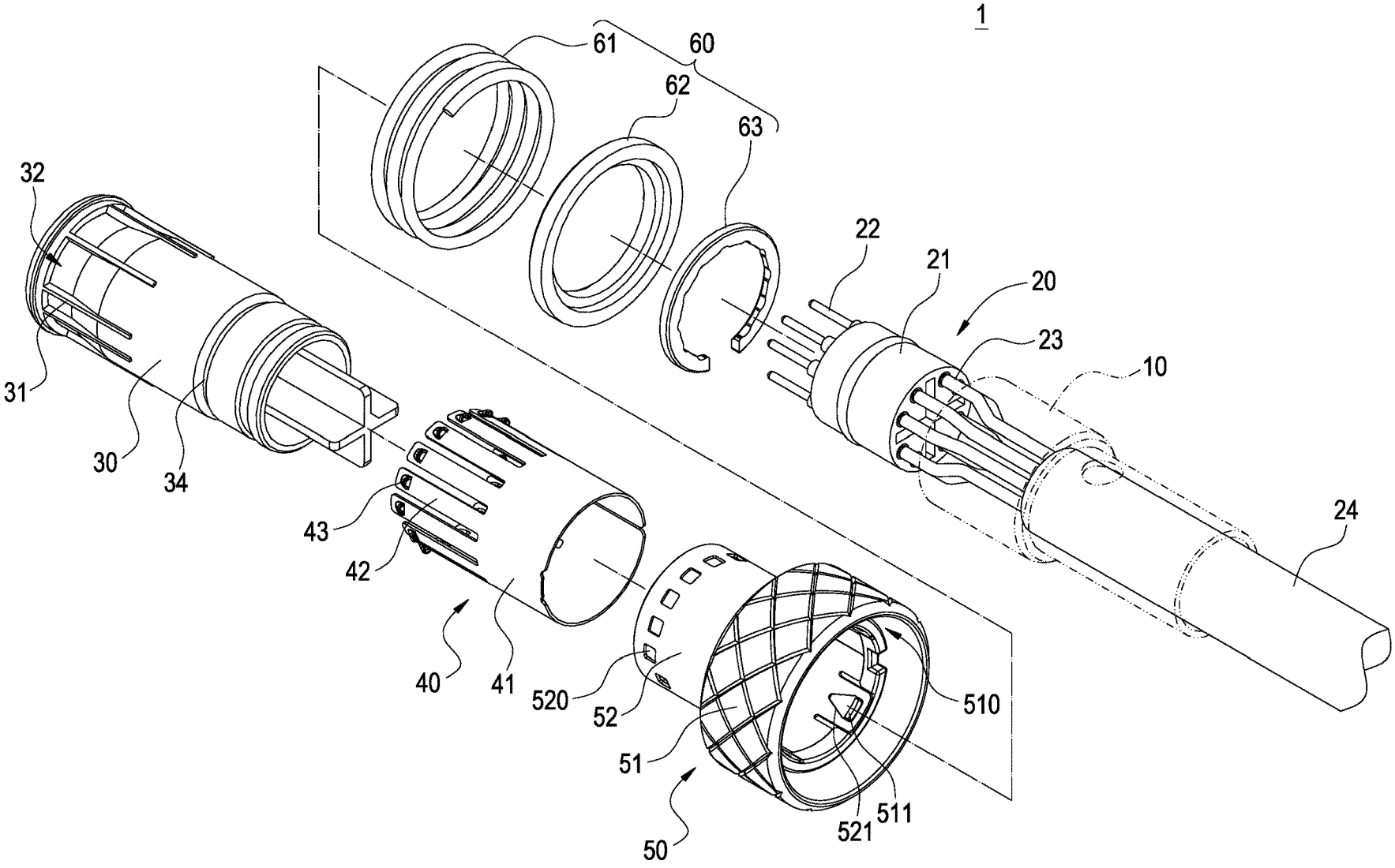

With reference to FIGS. 1 to 3 for a perspective view and two exploded views of a connector with a quick positioning structure of this disclosure respectively, the connector with a quick positioning structure comprises a plug structure 1 which further comprises a base 10, a terminal group 20, an inner socket 30, a positioning ring 40 and an outer socket 50. The terminal group 20 and the inner socket 30 are disposed on the base 10, and the positioning ring 40 and the outer socket 50 are disposed outside the inner socket 30 to form the plug structure 1. The plug structure 1 is described in details below.

The terminal group 20 is installed the base 10. The terminal group 20 comprises a terminal block 21 disposed at the base 10 and a plurality of conductive connecting terminals 22 installed in the terminal block 21. In addition, the terminal group 20 further comprises a conducting wire 23 electrically coupled to the conductive connecting terminals 22 and an insulating sleeve 24 sheathed on the conducting wires 23. An end of the insulating sleeve 24 is passed out of the base 10 to connect an electronic device.

It is noteworthy that the plug structure 1 can be installed directly on a circuit board without the conducting wires 23 and the insulating sleeve 24 in actual practices. In a preferred embodiment, the base 10 is made of an insulation material, but it may also be made of metal.

The inner socket 30 is fixed onto the base 10 and has the terminal group 20, and the positioning ring 40 is sheathed on the inner socket 30. In addition, the positioning ring 40 comprises a ring plate 41, a plurality of elastic plates 42 and a plurality of hooks 43 coupled to the ring plate 41. Further, the elastic plates 42 are spaced from each other and arranged circularly on the ring plate 41. The hooks 43 are configured to be corresponsive to the elastic plates 42. In this embodiment, each the hook 43 is a fingernail-shaped hook.

In addition, the outer socket 50 comprises an outer circular seat 51 disposed outside the inner socket 30 and an outer circular plate 52 coupled to the outer circular seat 51. The outer circular plate 52 has a plurality of notches 520 configured to be corresponsive to the hooks 43 respectively. Therefore, the outer circular seat 51 can be sheathed on the positioning ring 40 to protrude the hooks 43 out of the notches 520 respectively.

In an embodiment of this disclosure, the outer circular seat 51 has a plurality of hook portions 511 formed on an inner wall thereof. In addition, the outer circular plate 52 has a plurality of hook slots 521 formed at a bottom thereof. The outer circular seat 51 and the outer circular plate 52 are combined with each other by engaging the hook portions 511 into the hook slots 521. However, the outer circular seat 51 and the outer circular plate 52 may be formed integrally in actual practices.

In more detail, the inner socket 30 has a plurality of ribs 31 and a plurality of yield portions 32 disposed at an end thereof; and the yield portions 32 are formed between adjacent ribs 31 respectively, and the yield portion 32 has at least one elastic plate 42 passing through (as shown in FIG. 1). Therefore, the elastic plates 42 and the hooks 43 disposed thereon can slightly swing up and down in the yield portion 32. It is noteworthy that when the inner socket 30 rotates, the ribs 31 will stop the elastic plates 42 from rotating, so that the ribs 31 can prevent the inner socket 30 from having a rotation.

Figure 4:
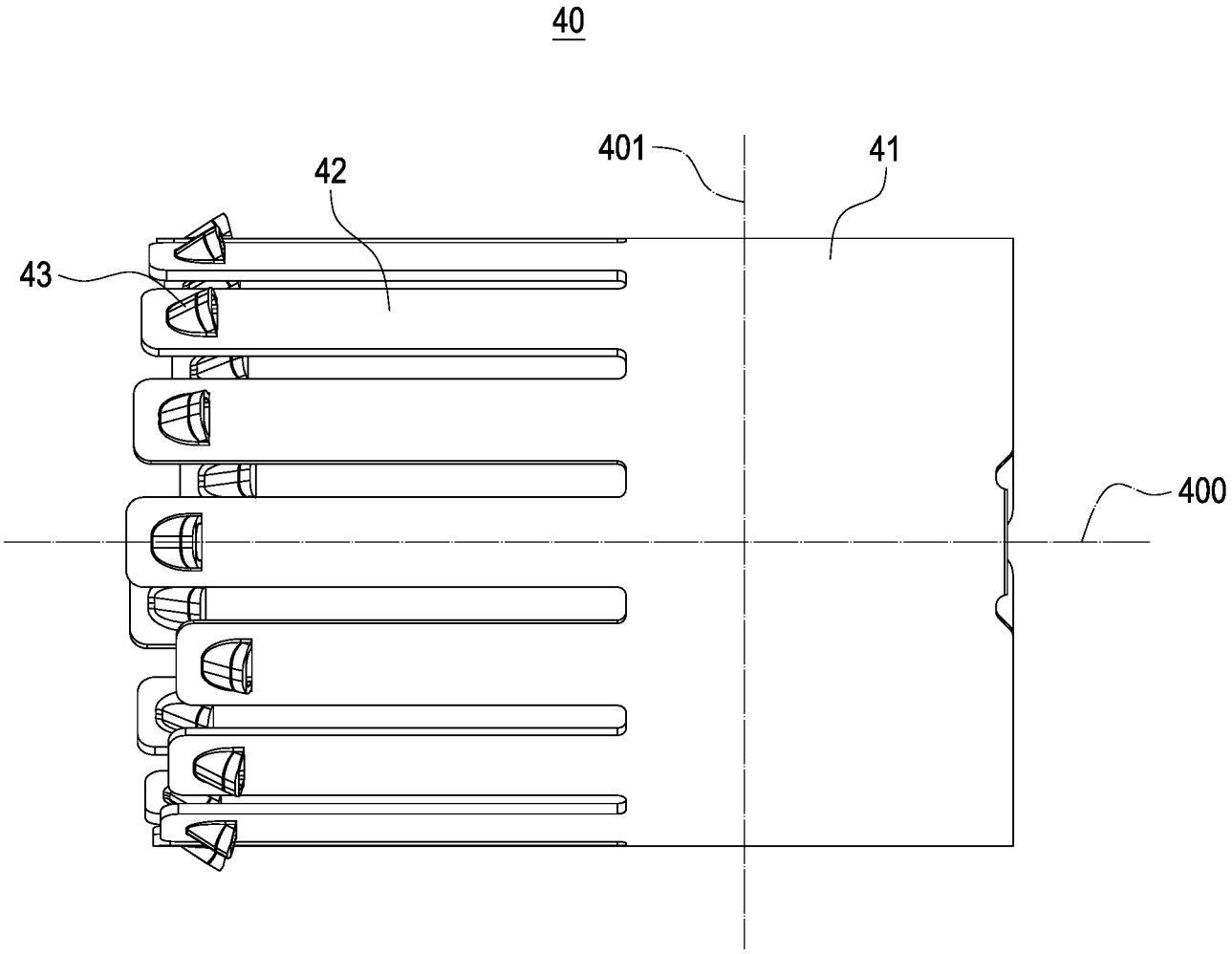
FIG. 4 is a planar side view of a positioning ring of this disclosure.

With reference to FIG. 4 for a planar side view of a positioning ring of this disclosure, the positioning ring 40 has an axial direction 400 and a horizontal plane 401 perpendicular to the axial direction 400. Further, the hooks 43 are installed on the elastic plates 42 and configured to be different or partially the same up to an axial distance of the horizontal plane 401. In an embodiment of this disclosure, the elastic plates 42 extend from the ring plate 41 to different heights, so that the hooks 43 disposed thereon are installed onto the elastic plates 42 in a different or partially the same manner up to the axial distance of the horizontal plane 401, so that the hook 43 of the elastic plates 42 are substantially in form of different heights.

It is noteworthy that some of the elastic plates 42 of this embodiment have a height equal to that of others up to the axial distance of the horizontal plane 401, so that each of the hooks 43 keeps a same distance from an end of and each of the respective elastic plates 42 to lead to the result of different heights. However, the height of each the elastic plate 42 is designed to be the same in this embodiment, but the distance of each of the hooks 43 from the end of each of the respective elastic plates 42 is different or partially the same to show the form of different heights.

Specifically, the plug structure 1 further comprises an elastic engaging group 60. The elastic engaging group 60 comprises a spring 61, an engaging ring 62 and a C-shaped retaining ring 63. The configurations of the spring 61, the engaging ring 62 and the C-shaped retaining ring 63 are shown in FIG. 5 and will be described in details below.

Figure 5:
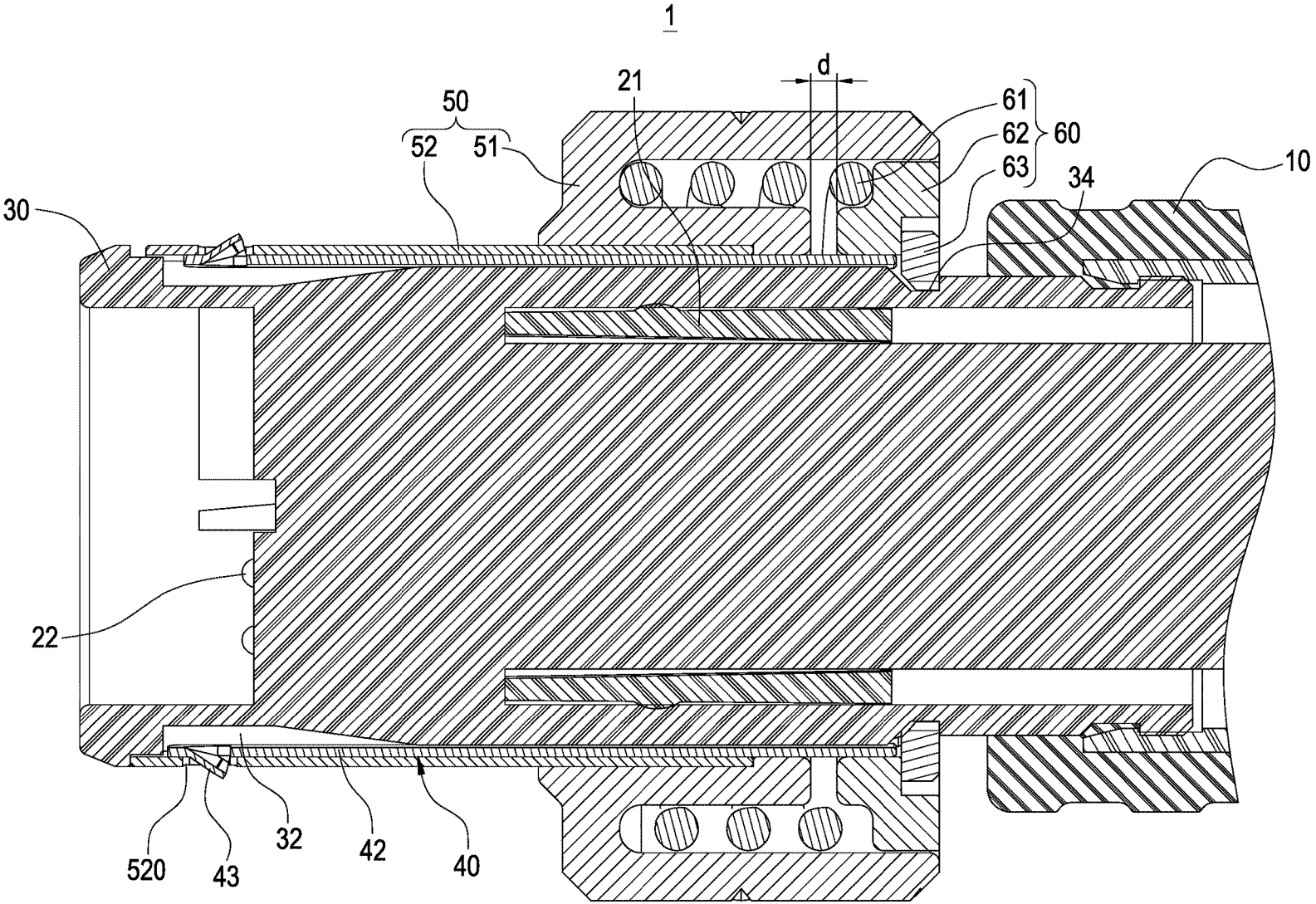
FIG. 5 is a partial cross-sectional view of a plug structure of this disclosure.

With reference to FIG. 5 for a partial cross-sectional view of an assembled plug structure of this disclosure, the outer circular seat 51 has a ring groove 510 formed thereon. Further, the spring 61 is installed in the ring groove 510, and the engaging ring 62 abuts a side edge of the ring groove 510, and the outer circular seat 51 can be moved with respect to the engaging ring 62.

In addition, the inner socket 30 has an engaging groove 34 formed thereon and configured to be corresponsive to a rear side of the engaging ring 62. The C-shaped retaining ring 63 is combined into the engaging groove 34 and abuts against a side of the engaging ring 62. Therefore, the outer circular seat 51 can be moved slightly with respect to the engaging ring 62. In this embodiment, the outer circular seat 51 can be moved in a distance with respect to the engaging ring 62. Further, the outer circular plate 52 coupled to the outer circular seat 51 can also be moved together with the outer circular seat 51 with respect to the elastic plates 42.

Figure 6:
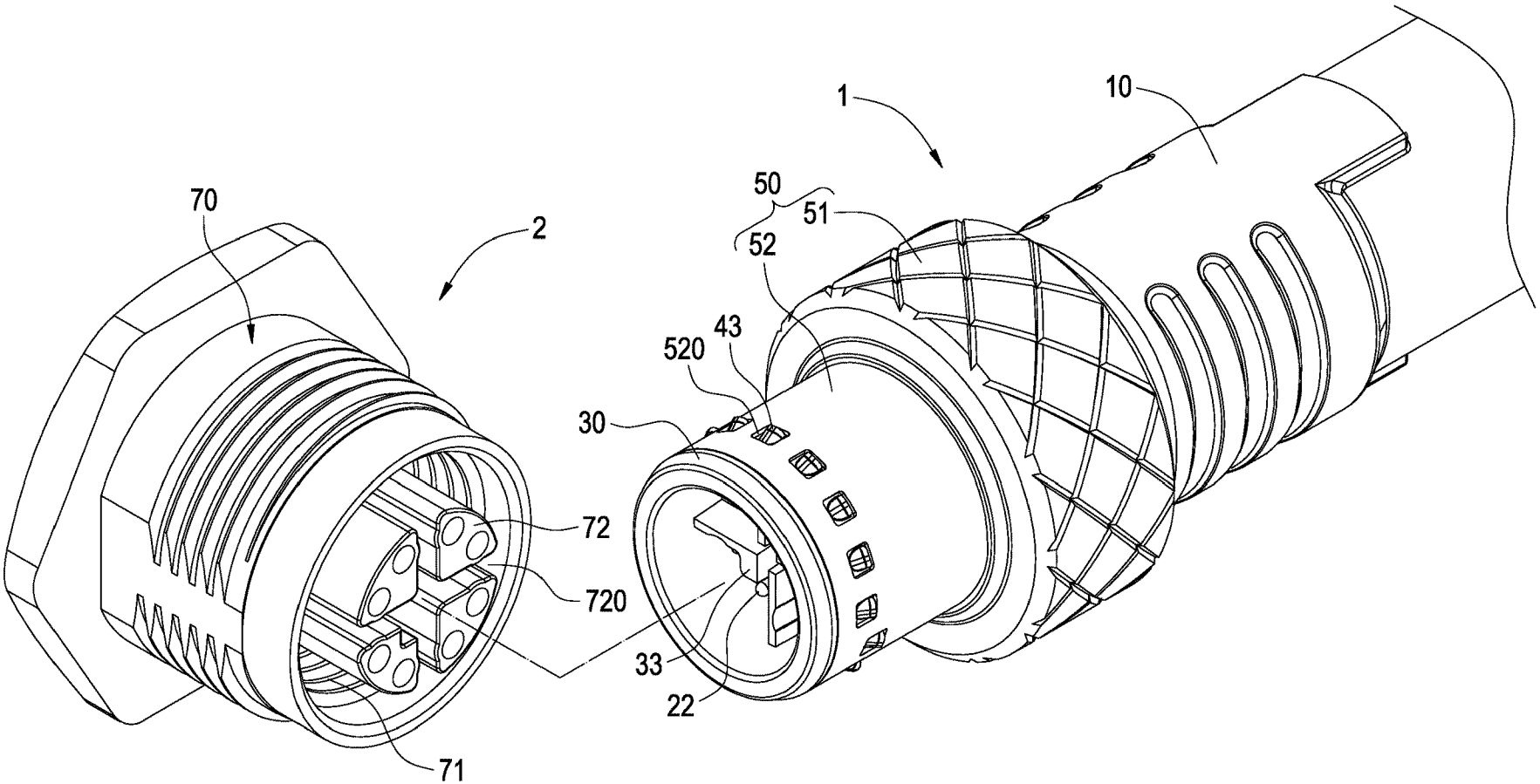
FIG. 6 is a schematic view of plugging a connector with a quick positioning structure of this disclosure.
Figure 7:
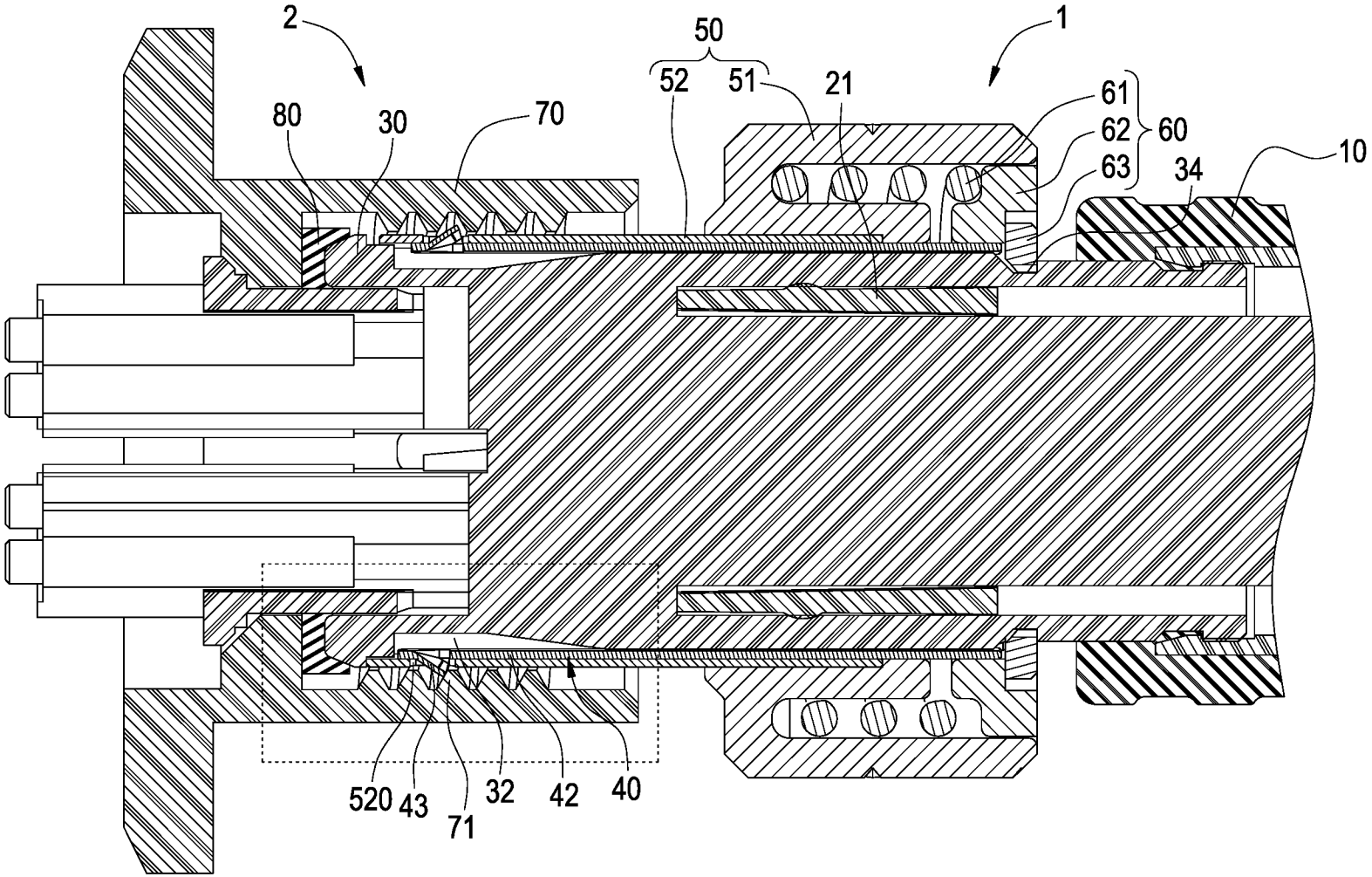
FIG. 7 is a cross-sectional view of a plugged connector with a quick positioning structure in accordance with this disclosure.

With reference to FIGS. 6 and 7 for a schematic view of plugging a connector with a quick positioning structure and a cross-sectional view of the plugged connector in accordance with this disclosure respectively, the plug structure 1 can be plugged into a socket structure 2 quickly. In FIG. 6, the connector with a quick positioning structure of this disclosure further comprises a socket structure 2 for engaging with the plug structure 1. The socket structure 2 comprises a socket body 70 and formed a plurality of threads 71 in the socket body 70.

It is noteworthy that the inner socket 30 has a plurality of plug plates 33. On the other hand, the socket body 70 has a plurality of guide columns 72 and a plurality of positioning grooves 720 formed between the guide columns 72. Therefore, when the plug structure 1 and the socket structure 2 are engaged with each other, the plug plates 33 will be plugged into the positioning grooves 720 respectively.

Figure 8:
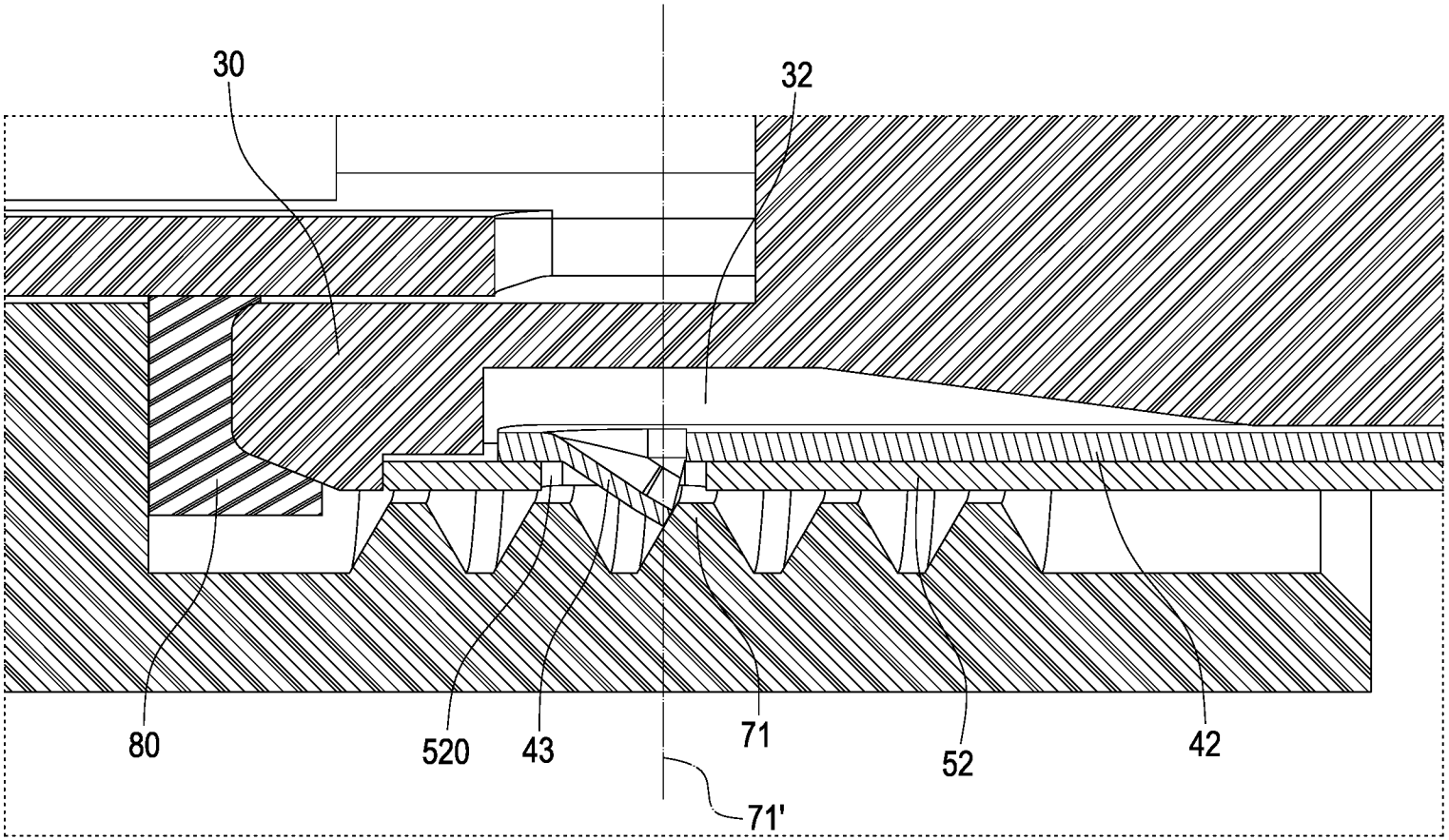
FIG. 8 is a partial cross-sectional view of a plugged connector with a quick positioning structure in accordance with this disclosure.

In an embodiment of this disclosure as shown in FIG. 7, the socket structure 2 further comprises a waterproof gasket 80 installed in the socket body 70, and the inner socket 30 of the plug structure 1 is inserted into the socket body 70 and stopped at the waterproof gasket 80. In FIG. 8, the inner socket 30 is plugged into the socket body 70, so that the hook 43 of the positioning ring 40 abuts against the threads 71 to position the plug structure 1 in the socket structure 2 securely.

Figure 9:
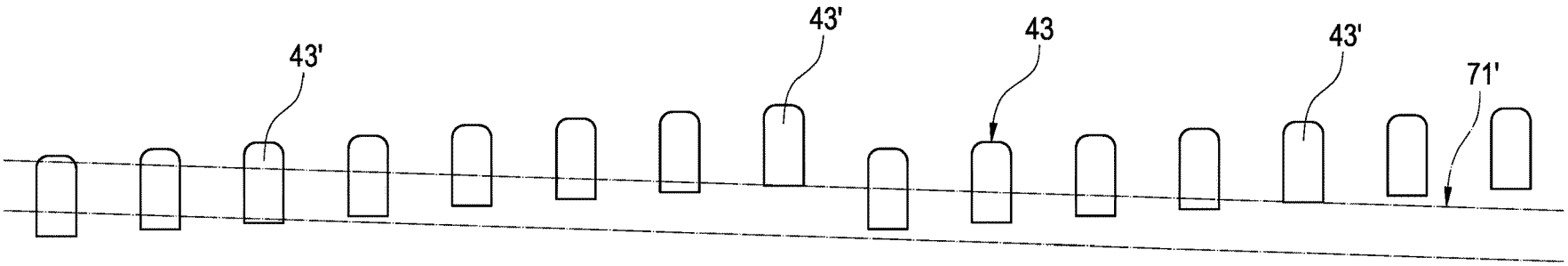
FIG. 9 is a schematic view showing the relative positions of a thread and a hook after the connector with a quick positioning structure of this disclosure is plugged.

With reference to FIGS. 8 and 9 for a partial cross-sectional view of a plugged connector with a quick positioning structure and s schematic view showing the relative positions of a thread 71 and a hook 43 in accordance with this disclosure, FIG. 8 shows that the axial section of the hook 43 is substantially in a triangular shape, and each of the hooks 43 are configured at different positions perpendicular to the axial direction of the positioning ring 40, and an end of some hooks 43 will abut against the thread 71. In addition, after the inner socket 30 of the plug structure 1 is inserted into the socket body 70, the inner socket 30 will extend into the interior of the socket body 70 until it touches the waterproof gasket 80. Now, at least three hooks 43' will abut against the threads 71 of the socket body 70 in the plurality of hooks 43 protruded from the notch 520 of the outer socket 50 in the plug structure 1.

With reference to FIG. 9 for a schematic view showing the relative positions of the hook 43 of the plug structure 1 and the thread 71 of the socket structure 2 when the inner socket 30 stops moving forward. In FIG. 9, the hooks 43 are arranged on the elastic plates 42 respectively in a partially the same way up to the axial distance of the horizontal plane 401. FIG. 9 shows that at least three hooks 43' among the hooks 43 have an end precisely disposed on a spiral line 71'. In other words, the hooks 43' will be engaged with the threads 71 to achieve a mutual positioning effect of the plug structure 1 and the socket structure 2.

It is noteworthy that the waterproof gasket 80 is pushed and compressed by the inner socket 30 to produce deformation. After the waterproof gasket 80 is deformed, the inner socket 30 can be extended further into the socket body 70, and the position of the hook 43 engaged with the thread 71 will be changed accordingly. However, even if the position of the hook 43 engaged with the thread 71 is changed, at least three hooks 43 will be engaged with the threads 71 to ensure the mutual positioning effect.

It is noteworthy that the hook 43 of the plug structure 1 of this disclosure can be abutted and engaged with the threads 71 of different shapes, so that the socket structure 2 still can be engaged with the plug structure 1 of a different specification, so as to improve the flexibility and practicality of use.

Figure 10:
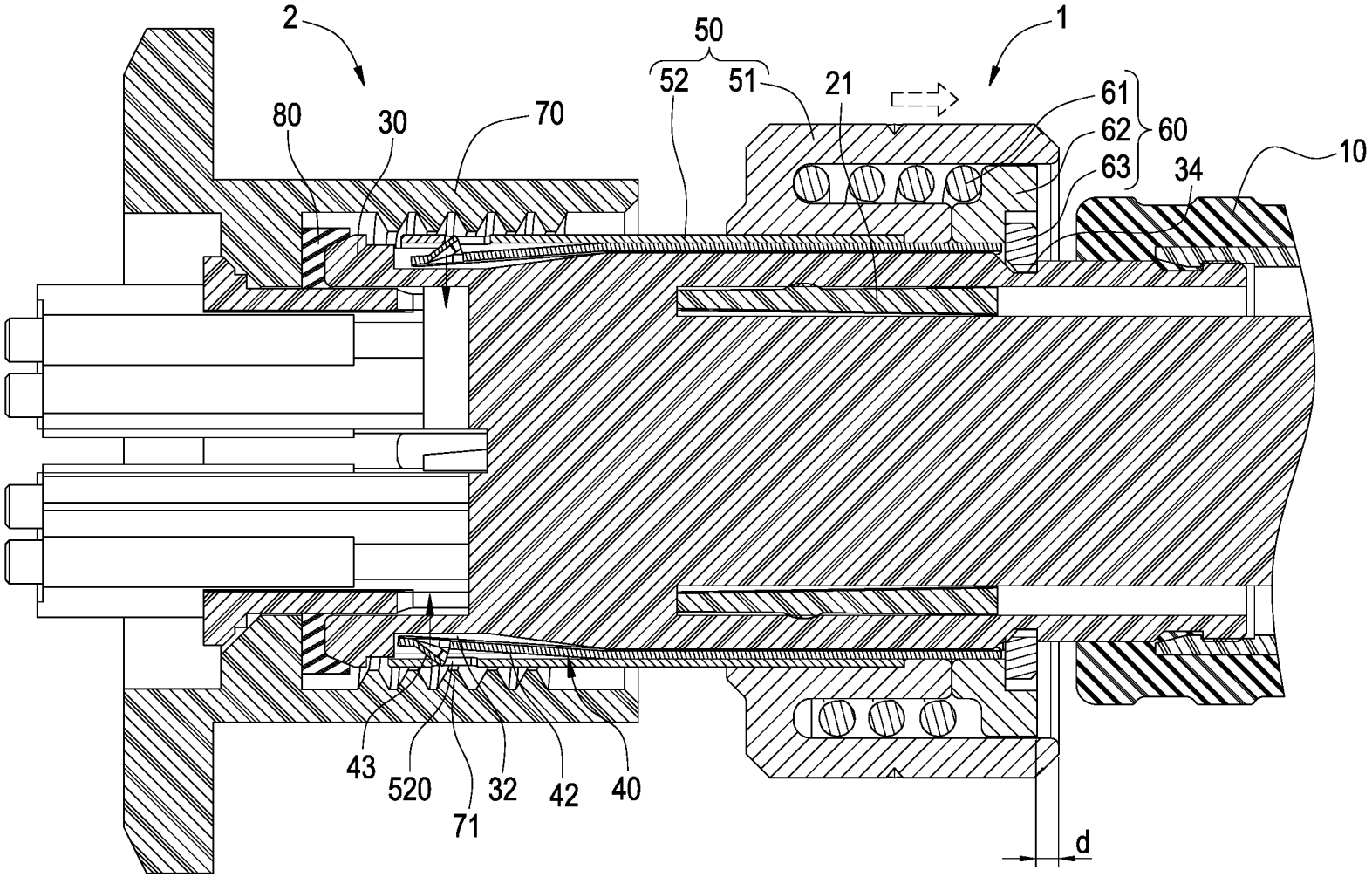
FIG. 10 is a schematic view of detaching a connector with a quick positioning structure in accordance with this disclosure.

With reference to FIG. 10 for a schematic view of detaching a connector with a quick positioning structure in accordance with this disclosure, the plug structure 1 can be detached from the socket structure 2 quickly. In FIG. 10, when the plug structure 1 is detached from the socket structure 2, a force is applied to the outer circular seat 51, so that the outer circular seat 51 moves towards the engaging ring 62 to produce a displacement d, and the outer circular plate 52 will move with the outer circular seat 51. Now, the outer circular plate 52 will press the hooks 43 to move the elastic plates 42 downwardly towards the yield portion 32 of the inner socket 30, so that the hooks 43 are released from the threads 71. Therefore, the plug structure 1 can be detached from the socket structure 2 easily.

Figure 11:
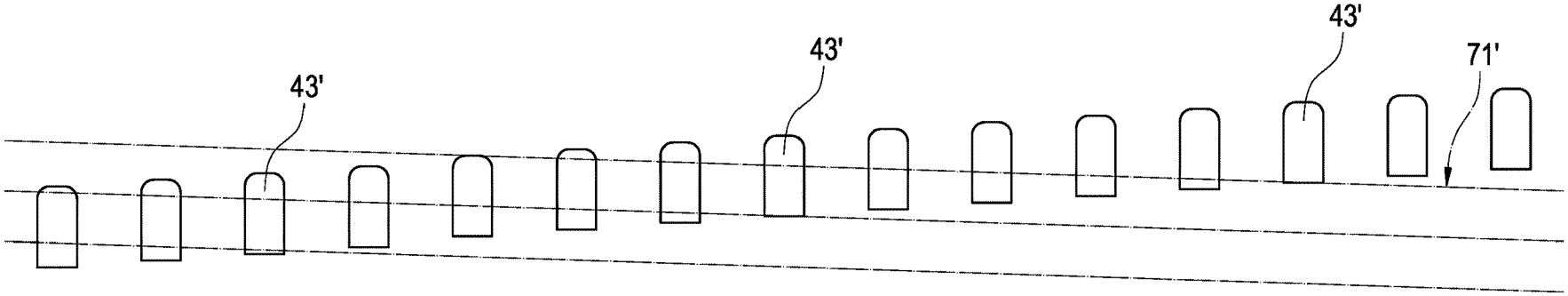
FIG. 11 is a schematic view showing other relative positions of a thread and a hook after the connector with a quick positioning structure in accordance with this disclosure is plugged.

With reference to FIG. 11 for a schematic view showing other relative positions of a thread and a hook in accordance with this disclosure after the connector with a quick positioning structure is plugged, the hooks 43 are arranged on the elastic plates 42 in different manners up to an axial distance of the horizontal plane 401. However, what is the same is that ends of at least three hooks 43' among the hooks 43 are disposed precisely on the spiral line 71'. In other words, the hooks 43' will be engaged with the thread 71 to achieve a mutual positioning effect of the plug structure 1 and the socket structure 2.

Figure 12:
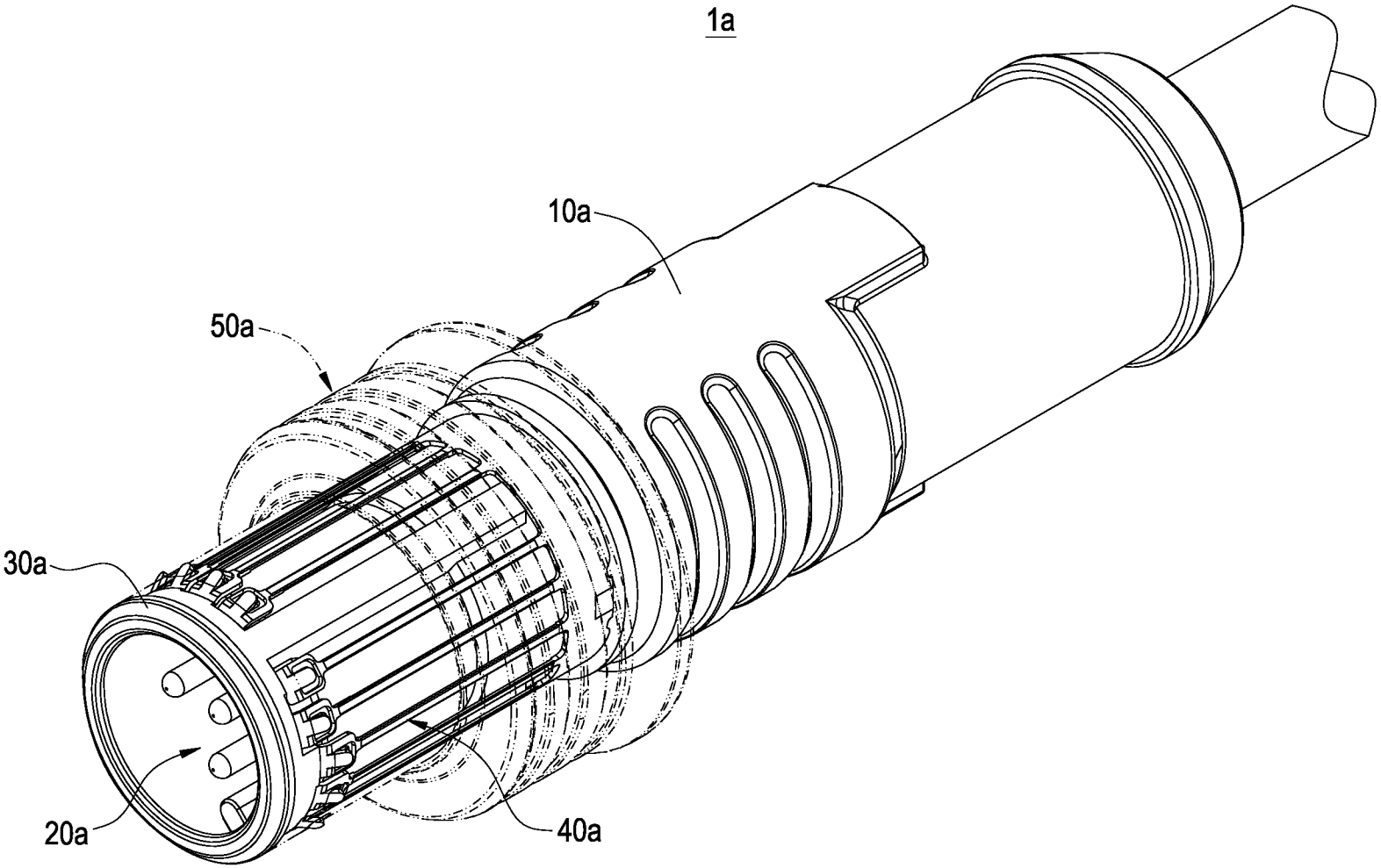
FIG. 12 is a perspective view of a plug structure in accordance with another embodiment of this disclosure.
Figure 13:
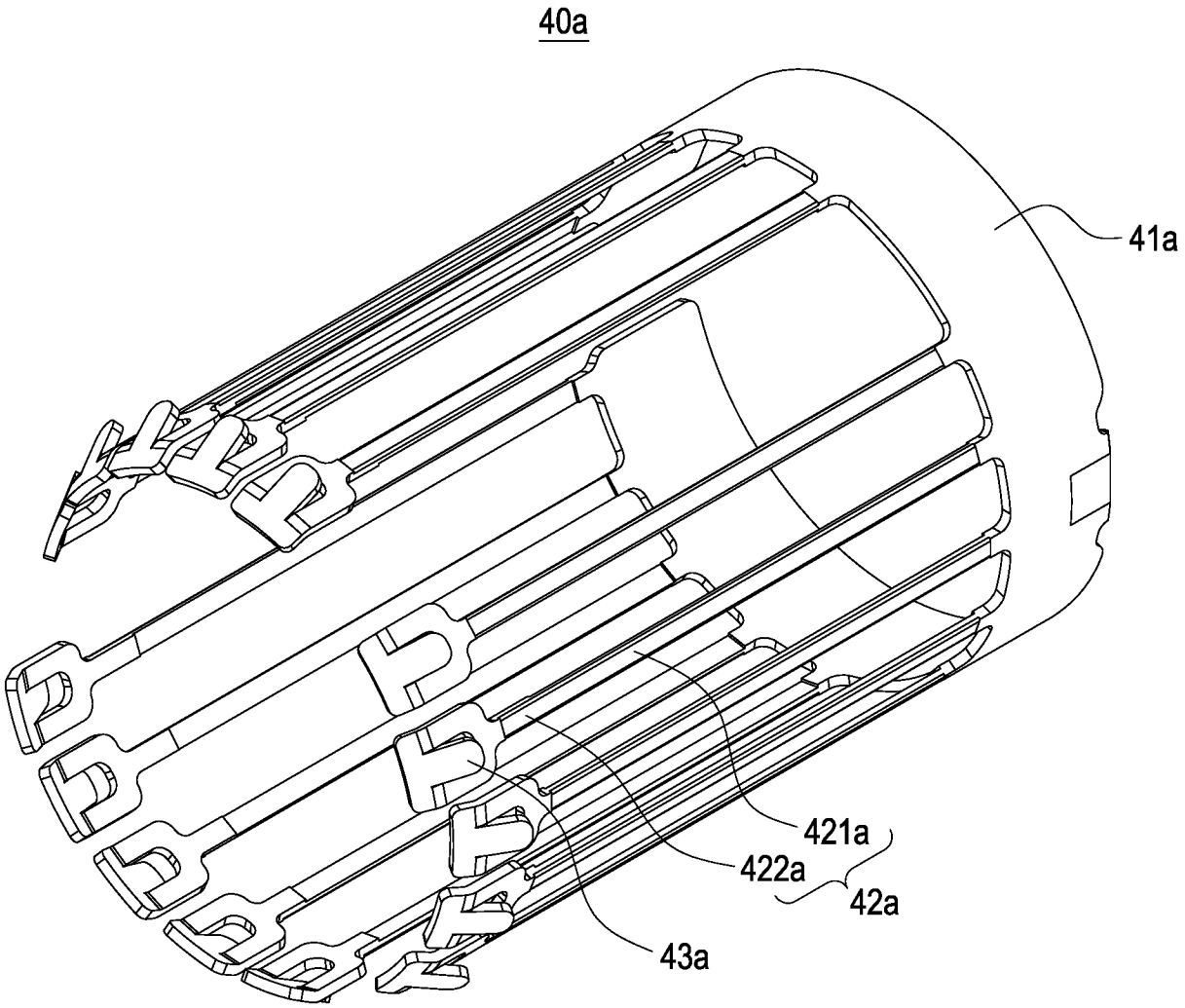
FIG. 13 is a perspective view of a positioning ring in accordance with another embodiment of this disclosure.

With reference to FIGS. 12 and 13 for a plug structure of another embodiment and a positioning ring of another implementation mode of this disclosure, the plug structure 1*a* as shown in FIG. 12 comprises a base 10*a*, a terminal group 20*a*, an inner socket 30*a*, a positioning ring 40*a* and an outer socket 50*a*. Compared with the previous embodiment, this embodiment has the structure including the positioning ring 40*a* and the corresponding inner socket 30*a*.

In FIG. 13, the positioning ring 40*a* comprises a ring plate 41*a*, plurality of elastic plates 42*a* and a plurality of hooks 43*a*. In addition, the elastic plates 42*a* are spaced from each other and arranged in a circular shape on the ring plate 41*a*; and the hooks 43*a* is configured to be corresponsive to the elastic plates 42*a*. In this embodiment, each of the hooks 43*a* is a tongue-shaped hook plate.

In this embodiment, each of the elastic plates 42*a* comprises a connecting section 421*a* coupled to the ring plate 41*a* and a hook section 422*a* having the hook 43*a*. Specifically, the connecting section 421*a* has a width smaller than that of the hook section 422*a*. In addition, the connecting section 421*a* has a thickness smaller than that of the hook section 422*a*. Therefore, the elastic plate 42*a* has a better deformability and improves the service life of the elastic plate 42*a*.

Figure 14:
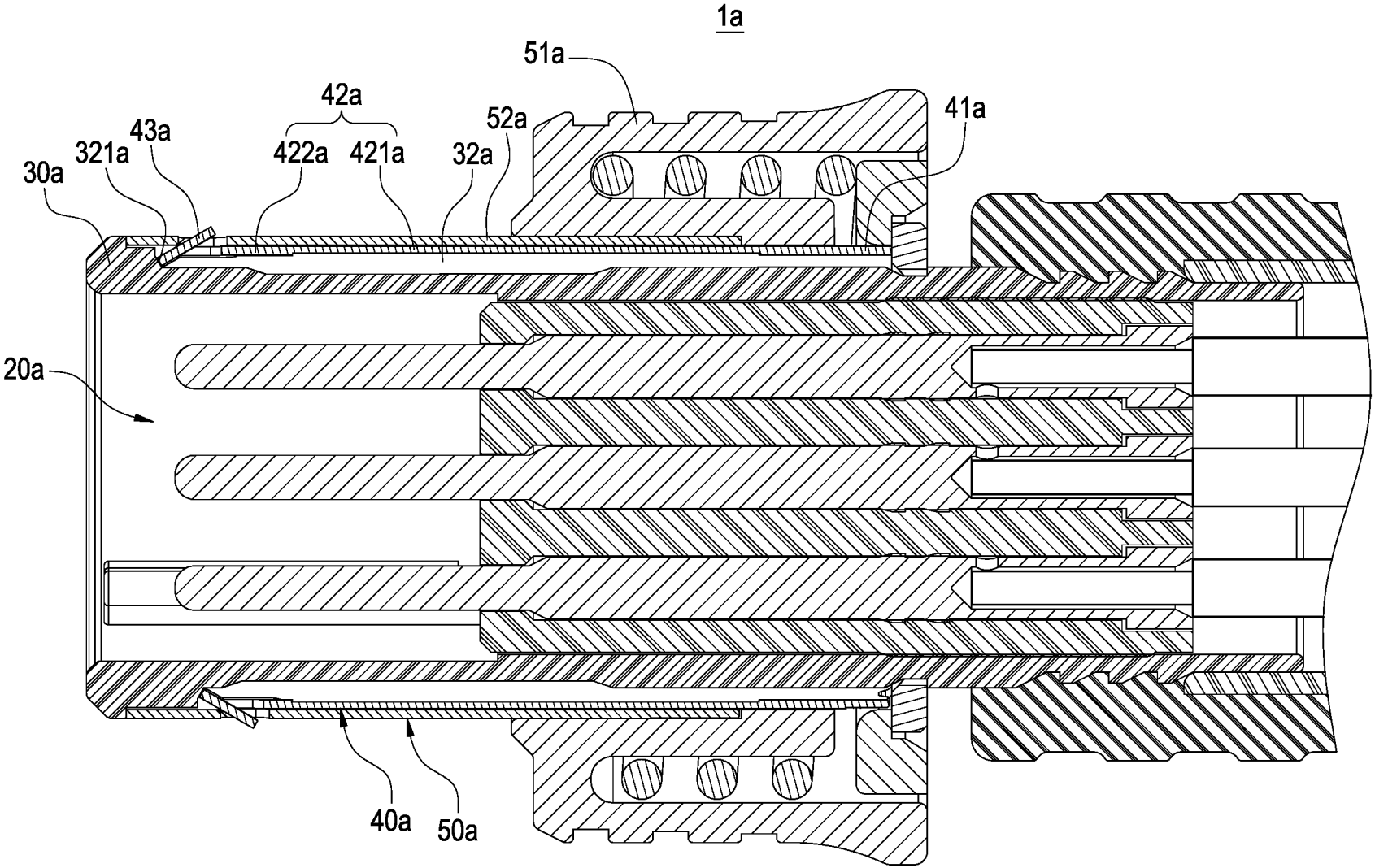
FIG. 14 is a partial cross-sectional view of a plug structure in accordance with another embodiment of this disclosure.
Figure 15:
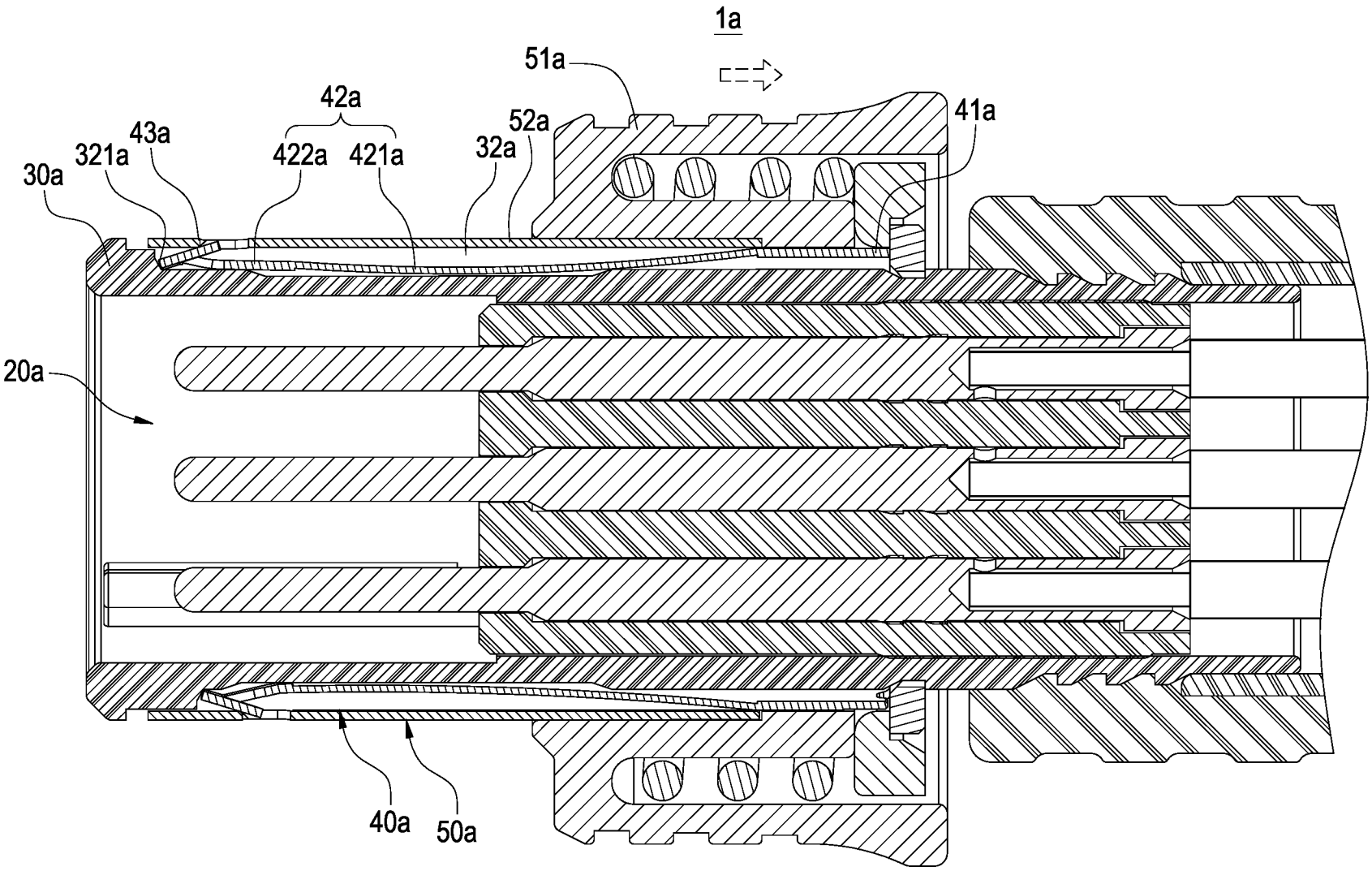
FIG. 15 is a schematic view showing a force exertion on a plug structure in accordance with another embodiment of this disclosure.

With reference to FIGS. 14 and 15 for a partial cross-sectional view of a plug structure and a schematic view showing a force exertion of the plug structure accordance with another embodiment of this disclosure respectively, FIG. 14 shows that the inner socket 30*a* is fixed onto the base 10*a* for passing the terminal group 20*a*, and the positioning ring 40*a* is sheathed on the inner socket 30*a*. In addition, the inner socket 30*a* has a plurality of yield portions 32*a*, and the yield portion 32*a* has at least one elastic plate 42*a*, and the elastic plate 42*a* and the hook 43*a* disposed on the elastic plate 42*a* can slightly swing up and down in the yield portion 32*a*. Further, the outer socket 50*a* comprises an outer circular seat 51*a* and an outer circular plate 52*a*.

It is noteworthy that the inner socket 30*a* of this embodiment has a bevel 321*a* formed at a front end of the yield portion 32*a*, and when the hook 43*a* is passed into the yield portion 32*a*, a side of the hook 43*a* abuts against the bevel 321*a*, and the design of this bevel 321*a* provides better fixing and pull-resisting effects of the hook 43*a*.

With reference to FIG. 15, the outer circular seat 51 moves towards a force applying direction when a force is applied to the outer circular seat Ma. Now, the outer circular plate 52*a* will press the hooks 43*a* to move the elastic plate 42*a* in the yield portion 32*a* downward, and the hooks 43*a* will be separated to achieve the effect of detachment.

While this disclosure has been described by means of specific embodiments, numerous modifications and variations could be made thereto by those skilled in the art without departing from the scope and spirit of this disclosure set forth in the claims.

What is claimed is:

1. A connector with a quick positioning structure and a plug structure, and the plug structure comprising:

a base;

a terminal group, installed in the base;

an inner socket, fixed onto the base, for passing the terminal group;

a positioning ring, sheathed on the inner socket, and extending in an axial direction and configured to be perpendicular to a vertical plane, and the positioning ring comprising a ring plate, and a plurality of elastic plates and a plurality of hooks coupled to the ring plate, and the elastic plates being spaced with each other and arranged in a circular shape on the ring plate, and the hooks being arranged on the elastic plates correspondingly and configured to have distances axially relative to an end of the ring plate being not equal or partially equal; and an outer socket, comprising an outer circular seat disposed outside the inner socket and an outer circular plate coupled to the outer circular seat, and the outer circular plate comprising a plurality of notches configured to be corresponsive to the hooks respectively, and the outer circular seat being sheathed on the positioning ring to protrude the hooks out of the notches.

2. The connector with a quick positioning structure as claimed in claim 1, wherein the terminal group comprises a terminal block disposed at the base and a plurality of conductive connecting terminals installed in the terminal block.

3. The connector with a quick positioning structure as claimed in claim 1, wherein the inner socket has a plurality of ribs and a plurality of yield portions disposed at an end of the inner socket, and the yield portions are formed between adjacent ribs respectively and include at least one elastic plate.

4. The connector with a quick positioning structure as claimed in claim 3, wherein the inner socket has a bevel formed at a front end of the yield portion.

5. The connector with a quick positioning structure as claimed in claim 4, wherein each of the hooks is a tongue-shaped hook plate, and a side of the hook abuts against the bevel.

6. The connector with a quick positioning structure as claimed in claim 1, wherein the elastic plates are extended out of the ring plate to different heights, and each of the hooks maintains a same distance from an end of each of the respective elastic plates.

7. The connector with a quick positioning structure as claimed in claim 1, wherein the plug structure further comprises an elastic engaging group, and the elastic engaging group comprises a spring and an engaging ring, and the outer circular seat has a ring groove, and the spring is installed in the ring groove, and the engaging ring abuts against a side edge of the ring grooves, and the outer circular seat is capable of moving the engaging ring.

8. The connector with a quick positioning structure as claimed in claim 7, wherein the elastic engaging group further comprises a C-shaped retaining ring, and the inner socket has an engaging groove configured to be corresponsive to a rear side of the engaging ring, and the C-shaped retaining ring is combined into the engaging groove and abuts against a side of the engaging ring.

9. The connector with a quick positioning structure as claimed in claim 1, wherein the outer circular seat has a plurality of hook portions formed on an inner wall thereof, and the outer circular plate has a plurality of hook slots formed at the bottom thereof, and the outer circular seat and the outer circular plate are combined with each other in the hook slots by engaging the hook portions.

10. The connector with a quick positioning structure as claimed in claim 1, wherein each of the elastic plates includes a connecting section coupled to the ring plate and the hook includes a hook section, and the connecting section has a width smaller than that of the hook section.

11. The connector with a quick positioning structure as claimed in claim 10, wherein the connecting section has a thickness smaller than that of the hook section.

12. A connector with a quick positioning structure, comprising a plug structure as claimed in claim 1 and a socket structure configured to be engaged with the plug structure, and the socket structure comprising a socket body and a plurality of threads formed in the socket body, and the inner socket being inserted into the socket body and abutting the plurality of hooks to be engaged with the threads.

13. The connector with a quick positioning structure as claimed in claim 12, wherein the socket structure further comprises a waterproof gasket installed in the socket body, and the inner socket is inserted into the socket body to abut and stop the waterproof gasket.

14. The connector with a quick positioning structure as claimed in claim 12, wherein the inner socket has a plurality of plug plates formed thereon, and the socket body has a plurality of guide columns and a plurality of positioning grooves formed between the waterproof gasket, and the plug plates are plugged into the positioning grooves respectively.

* * * * *